US006152233A

United States Patent [19]

Jani et al.

[11] Patent Number: 6,152,233

[45] Date of Patent: Nov. 28, 2000

[54] SURGE ANCHOR ASSEMBLY

[76] Inventors: William Jani, Site 36, Box 48, Calgary, AB, Canada, T2M 4L4; Roy Hansen, #3, 3600-21st Street, NE., Calgary, AB, Canada, T2E 6V6

[21] Appl. No.: 09/231,274

[22] Filed: Jan. 15, 1999

[30] Foreign Application Priority Data

Jan. 15, 1998 [CA] Canada ..... 2223870
Jul. 24, 1998 [CA] Canada ..... 2241360

[51] Int. Cl.[7] ..... E21B 23/00

[52] U.S. Cl. ..... 166/382; 166/117; 166/123; 166/134; 166/137; 166/182; 166/211; 166/215; 166/216; 166/217

[58] Field of Search ..... 166/382, 381, 166/117, 118, 123, 134, 136, 137, 182, 206, 211, 215, 216, 217

[56] References Cited

U.S. PATENT DOCUMENTS 4,122,899 10/1978 Brieger .
4,345,649 8/1982 Baugh et al. .
4,375,834 3/1983 Trott .
4,415,029 11/1983 Pratt et al. .
4,518,037 5/1985 Youngblood et al. ..... 166/125
5,103,902 4/1992 Ross et al. ..... 166/120
5,131,468 7/1992 Lane et al. ..... 166/120
5,146,993 9/1992 Gambertoglio ..... 166/387
5,700,968 12/1997 Blimke .

*Primary Examiner*—Roger Schoeppel
*Attorney, Agent, or Firm*—Andrus, Sceales, Starke & Sawall

[57] ABSTRACT

The present invention is a surge anchor mechanism which includes a main body, lower unit slidable in relation to the main body, and slip members. The slip members have at least one inclined end surface. The lower unit has an inclined surface forming a frustoconical shape wherein the slope of the surface complements the inclined end surface of the slip member. The lower unit is aligned along the axis of the main body and movable in relation to the main body along this axis. The slip members are biased towards the lower unit and movable transversely in relation to the axis of the lower unit. As a surge occurs in the well, the lower unit and the main body are forced towards each other. This causes the inclined surface of the lower unit to cooperate with and move along the corresponding inclined surface of the slip member forcing the slip member outward from the lower unit and into engagement with the well casing. As the surge passes, the lower unit returns to its lowered starting position allowing the slip member to disengage the well casing and return to a resting position.

18 Claims, 6 Drawing Sheets

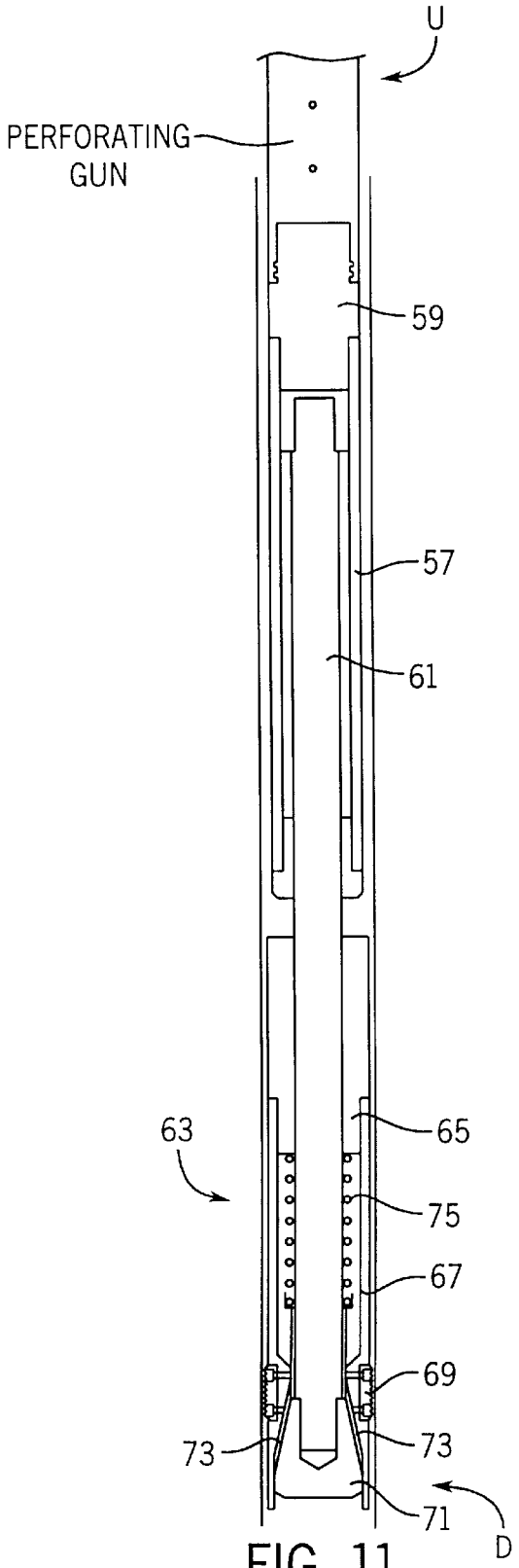
FIG. 11
FIG. 12
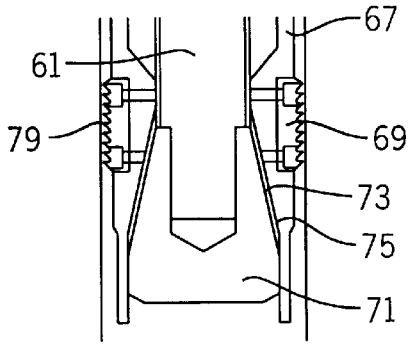
FIG. 13
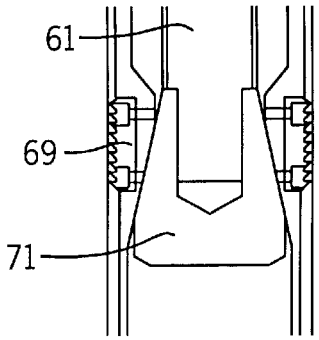

SURGE ANCHOR ASSEMBLY

FIELD OF THE INVENTION

The present invention relates to the field of surge anchors for downhole assemblies for oil and gas wells and in particular for gas wells.

BACKGROUND OF THE INVENTION

To access hydrocarbon formations, a downhole assembly is lowered into a cased borehole in a well. A perforating gun or other tool connected to the downhole assembly is positioned adjacent to a hydrocarbon formation. The gun is detonated perforating the formation and fluid from the formation enters the borehole. The sudden surge of pressure in the well upon detonation of the perforating gun forces the equipment upward in the borehole. This surge of pressure may be caused by the denotation of the perforating gun or by the release of pressure from the formation. This sudden force may cause damage to the equipment. Surge anchors stop this sudden movement of the equipment by deploying slips which grip the casing wall and lock the equipment in position.

Anchoring devices are known to include a number of slip members with opposed camming surfaces which cooperate with complementary opposed frustoconical wedging surfaces. Such a device is disclosed in U.S. Pat. No. 4,345,649 issued Aug. 24, 1982 to Hughes Tool Company. This patent teaches a well packer having a seal assembly and an anchoring device. The anchoring device includes wedge members and slip members having complementary surfaces to cooperate with the surfaces of the wedge members. When the wedge members are moved into contact with the slip members through reaction to fluid pressure and piston movement, the slip members are pushed outward into contact with the well casing or liner. However, this anchoring device depends upon the shearing of set screws attaching the wedge members to the slip cage of the well packer. Once the screws have been sheared, the device cannot be reset in anchored relation to the well casing. Instead, the assembly must be removed from the borehole and the screws or the assembly replaced.

There therefore is a need for a device which can be repeatedly set to anchor a downhole assembly to a well casing.

There is also a need for an anchoring system which will automatically set when a surge occurs in a well.

There is also a need for an assembly which is simple in design and economical to manufacture and use.

SUMMARY OF THE INVENTION

The present invention overcomes the disadvantages of the prior art and provides a surge anchor for anchoring a downhole assembly or other tool to a well casing.

The present invention provides a surge anchor which will repeatedly anchor a downhole assembly or other tool to a well casing without the need for removing the tool or assembly from the well between settings.

The present invention further provides a surge anchor which automatically anchors the downhole assembly whenever a surge occurs from the perforating equipment or other tools.

The present invention further provides a surge anchor which eliminates the need for the injection of incompatible fluids to prevent and control surges while perforating under balanced.

The present invention provides for an anchoring mechanism for anchoring a downhole assembly attachable thereto to a casing of a well bore, said mechanism comprising: an elongated main body extending along an axis; a first housing on said main body, said main body being slidably movable in relation to said first housing; a second housing on said main body apart from said first housing and having an external first ramp sloped radially inwardly towards the first housing; a slip member between said first and second housing and radially movable between a retracted position wherein the slip does not engage the casing and an anchoring position wherein the slip member engages the casing, the slip member having a first sloped end surface complementary to said first ramp; said first ramp being movable towards said first housing upon movement of said main body from a first position wherein the first ramp is apart from said first sloped end surface to a second position wherein said first ramp cooperates with said first sloped end surface for forcing said slip member radially outwardly into said anchoring position for substantially locking the anchor to the casing against axial movement.

In one embodiment of the present invention there is provided an anchoring mechanism for an assembly in a bore comprising a first housing having a first end having a first radially inwardly sloped outer surface; a second housing having a second end telescopingly received into the first housing in an extended position and wherein the second housing includes a second radially inwardly sloped surface, wherein said sloped surfaces define a recess; means in said first housing for allowing said second housing to telescopingly move in said first housing independently of said first housing from said extended position to a fully inserted position; and at least one slip member received in said recess and having sloped surfaces corresponding to said sloped surfaces on said first and second housings; wherein said slip member is movable between a retracted position in said recess when said second housing is in an extended position to an anchor position engaging the wall of the bore when said second housing is in a fully inserted position.

BRIEF DESCRIPTION OF THE DRAWINGS

Preferred embodiments of the present invention will now be described and may be better understood when read in conjunction with the following drawings in which:

FIG. 11 is a front cross-sectional view of an alternative embodiment of the surge anchor of the present invention.

FIG. 12 is a front elevational cross-sectional view of the slips of the anchor of FIG. 11 in a resting position.

FIG. 13 is a front elevational cross-sectional view of the slips of the anchor of FIG. 11 in an anchored position.

DETAILED DESCRIPTION OF THE INVENTION

With reference to the Figures, there is provided a surge anchor mechanism for a downhole assembly.

The present invention incorporates two embodiments which operate in the same manner to anchor the assembly to the casing wall. Each of these embodiments incorporates a main body, lower unit slidable in relation to the main body, and slip members. The slip members have at least one inclined end surface. The lower unit has an inclined surface forming a frustoconical shape wherein the slope of this surface complements the inclined end surface of the slip member. The lower unit is aligned along the axis of the main body and movable in relation to the main body along this axis. The slip members are biased towards the lower unit in a retracted position and movable radially in relation to the axis of the lower unit.

As a surge occurs in the well, the lower unit and the main body are forced towards each other. This causes the inclined surface of the lower unit to cooperate with and move along the corresponding inclined end surface of the slip member forcing the slip member outward from the lower unit and into engagement with the well casing. As the surge passes, the lower unit returns to its lowered starting position allowing the slip member to disengage the well casing and return to the retracted position.

The inclined surfaces of the slip members and the lower unit are preferably at approximately a complementary 10–15° angle. This angle provides for optimum leverage of the slip members in a radial direction into engagement with the casing.

Figure 15A:
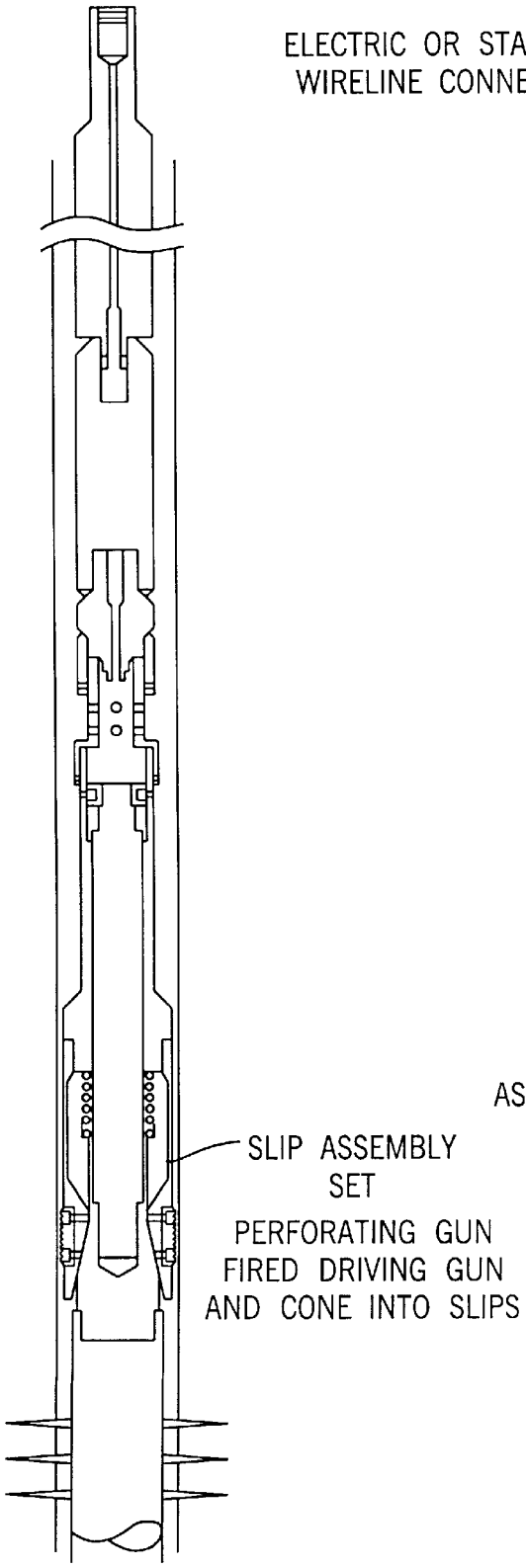
FIG. 15 is a side cross-sectional view of an alternate embodiment of the surge anchor shown in FIG. 11 with FIG. 15A showing the anchor positioned uphole of the perforating equipment and in a set position and FIG. 15B showing the slip members in a retracted position.
Figure 15B:
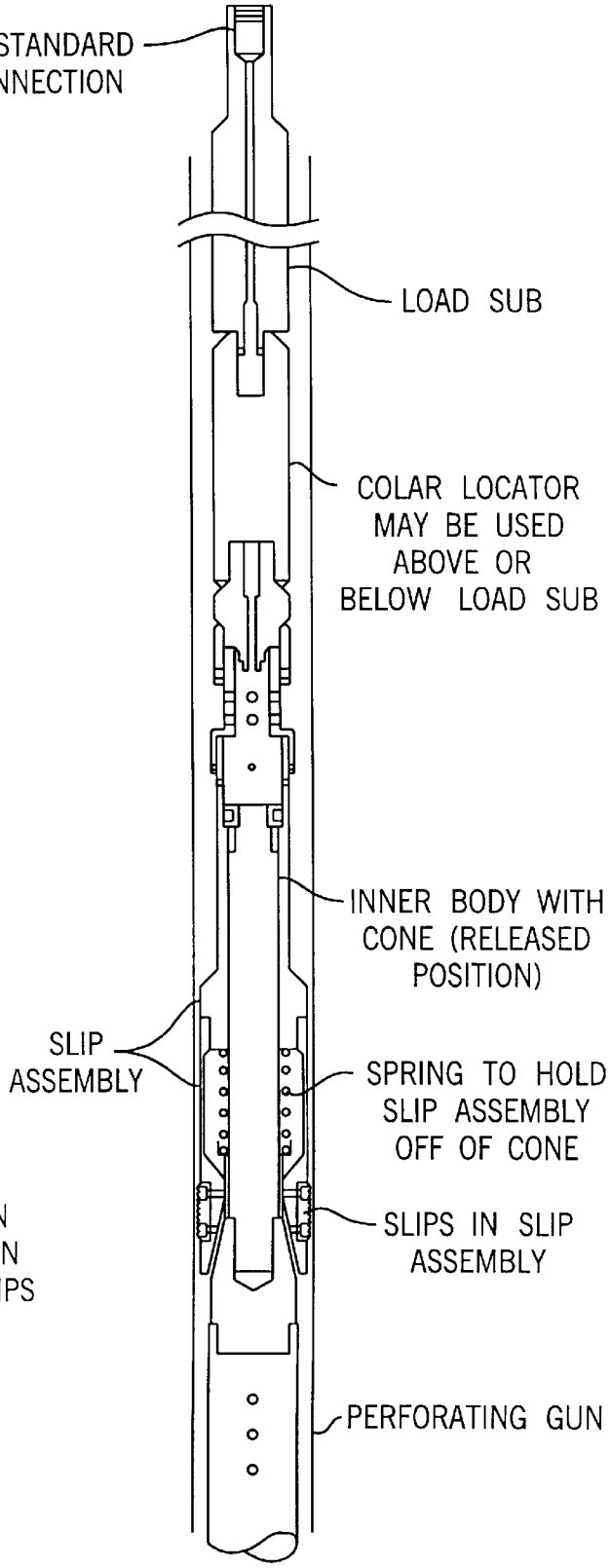

Referring to FIGS. 11–13, this first embodiment is a simplified version of the surge anchor shown in FIGS. 1–10 and utilizes simple mechanical interactions. It is preferably used downhole of the perforating equipment and perforating gun. When this surge anchor is positioned uphole of the perforating gun, it is preferable to use the alternate configuration shown in FIG. 15. This configuration sets the slip members and anchors the equipment in the same manner as previously described. However, the connector sub connects to a coupling, collar locator and load sub arrangement. This arrangement is described in more detail below with reference to FIGS. 1 to 10.

As shown in FIG. 11, the anchor has a main mandrel 61 slidably received along the main axis of the anchor assembly. At the downhole end D, the mandrel 61 is connected to the slip assembly 63 and, at its uphole end U, to a jar body 57 and coupling 59 spaced apart from the slip assembly 63. The uphole end U attaches to a wireline. The perforating gun is preferably positioned uphole of the anchor but may be also positioned downhole.

The slip assembly 63 of this embodiment is structurally similar to that described below and comprises a connector sub 65, slip sub 67, slip members 69, and lower cone 71. The lower cone 71 is attached to the downhole end D of the main mandrel 61. It is frustoconically shaped having outer surfaces which are inclined in an uphole to downhole direction. Positioned uphole of the lower cone 71 is a connector sub 65. This sub is concentrically placed around the main mandrel 61. A spring 75 separates the lower cone 71 from the connector sub 65. The lower cone 71 includes a sear for receiving the spring. A recess is formed between the lower cone 71 and the connector sub 65.

The slip sub 67 is attached to the connector sub 65 and positioned concentrically on the main mandrel 61 uphole of the lower cone 71. The slip sub 67 is shown as threadedly connected to the connector sub 65 but other connecting means may be used. The slip sub 67 extends along but is spaced apart from the main mandrel 61. The slip members 69 are positioned near the downhole end of the slip sub 67. The slip members 69 extend into the recess created between the lower cone 71 and the connector sub 65 and have an inner inclined surface 77. The slip sub 67 is somewhat flexible and, as a result, the slip members 69 are biased towards the lower cone 71 and main mandrel 61. This prevents the slip members from contacting the well casing during insertion and removal of the surge anchor from the well and while in a resting position. The inclined end surface 77 complements the inclined surface 73 on the lower cone 71 and cooperates with this surface to force the slip members 69 outwardly into engagement with the well casing when the surge anchor is activated. The slip members 69 have an outer surface 79 which is serrated to engage the well casing. Other arrangements on the outer surface may be used to ensure engagement with the well casing when the anchor is in an anchored position. FIGS. 11–13 show two slip members, however, any number of members may be used.

As the perforating equipment is detonated in the well, a recoil of the equipment is caused. This surge of pressure forces the main mandrel in an uphole direction. As the main mandrel 61 moves upward, the lower cone 71 is drawn with it. At the same time as this surge occurs driving the main mandrel 61 upwards, an opposite pressure force is released in a downhole direction forcing the connector sub 65 downwards. As a result, the spring 75 compresses and the inclined surface 73 of the lower cone 71 cooperates with the inclined surfaces 77 of the slip members 69 driving the slip members 69 outward and into engagement with the well casing. The surge anchor is now anchored to the well casing as is shown in FIG. 13. As the pressure passes, the spring 75 may uncompress and the lower cone 71 and the main mandrel 61 may return to their starting position. As the inclined surface 73 of the lower cone 71 disengages the inclined surfaces 77 of the slip members 69, the slip members 69 will also return to their retracted position biased towards the main mandrel 61 and away from the well casing as is shown in FIG. 12. The anchor may also be released by using the slip joint located at the upper end of the tool. By pulling and/or jarring down with the wireline, the slip joint will release the lower cone and allow the slip members to return to their retracted position and disengage the casing. Alternatively, if the surge anchor is positioned uphole of the perforating equipment, a sinker bar may be used to release the lower cone and allow the slip members to return to their retracted position. The surge anchor may remain set or reset when the surge of pressure travels the length of the well. The surge anchor may be repeatedly set in response to surges occurring in the well.

Figure 1:
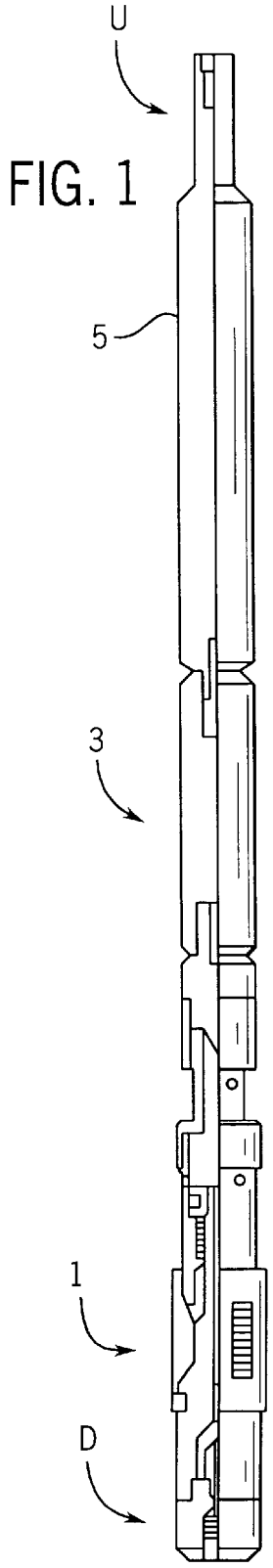
FIG. 1 is an perspective, partial cross-sectional view of a downhole assembly including an embodiment of the present anchoring mechanism.
Figure 14A:
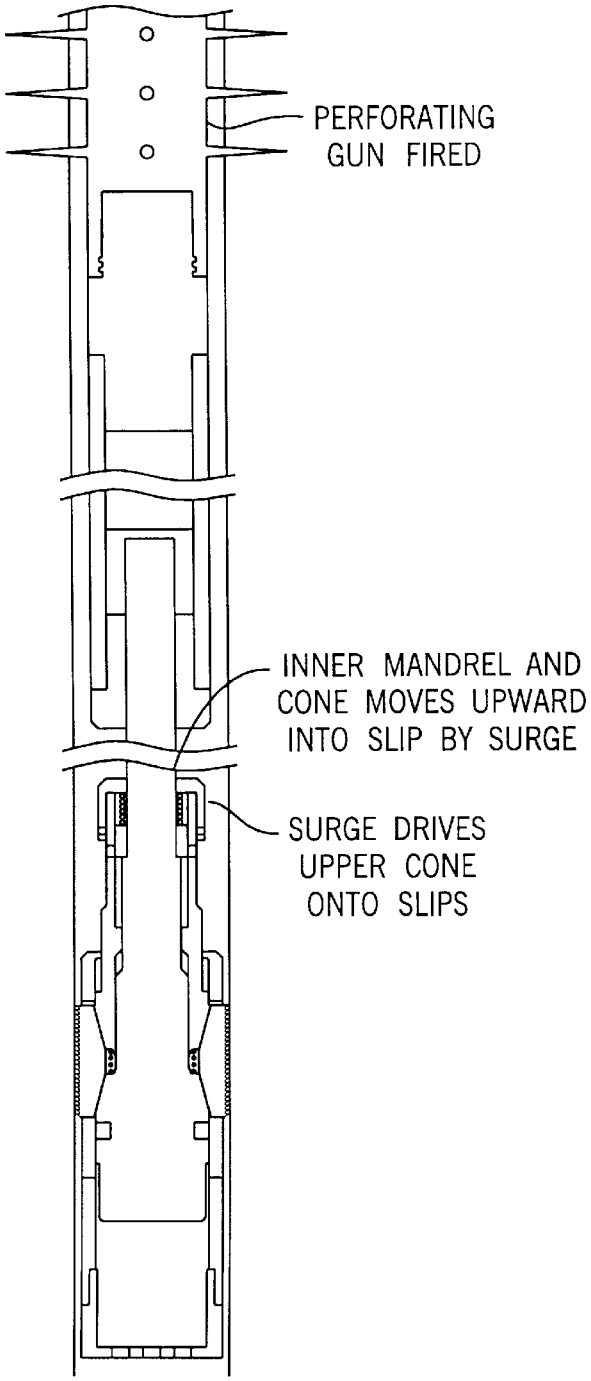
FIG. 14 is a side cross-sectional view of an alternate embodiment of the surge anchor shown in FIG. 1 with FIG. 14A showing the anchor positioned downhole of the perforating equipment and in an anchored position and FIG. 14B showing the slip members in a retracted position.
Figure 14B:
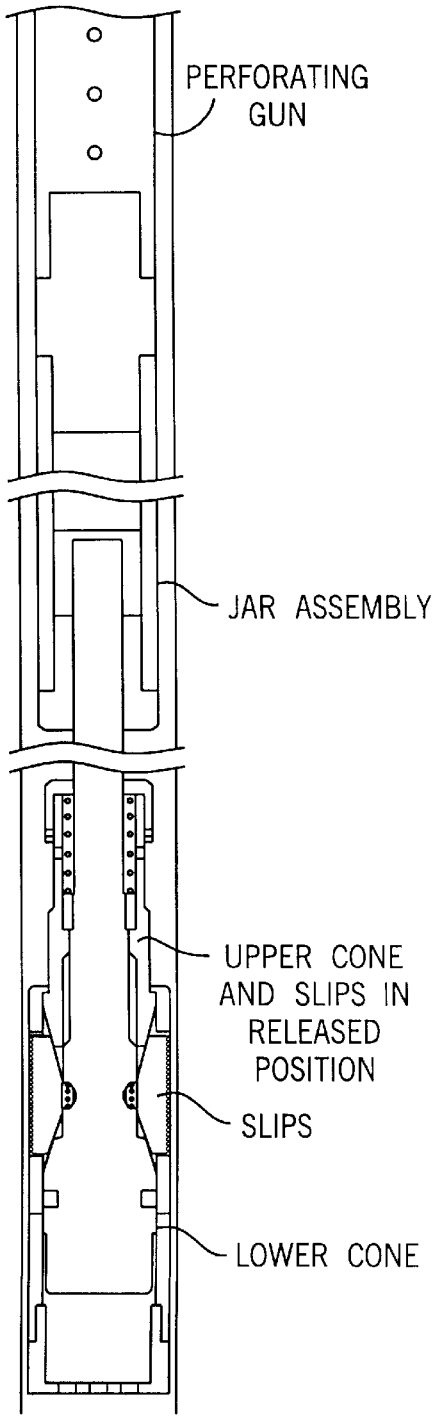

Referring to FIG. 1, in an alternate embodiment of the present invention, the surge anchor utilizes inclined surfaces on both the uphole and downhole ends of the slip members for a more secure setting engagement with the well casing. While this anchor is preferably used uphole of the perforating gun, it may be positioned either uphole or downhole of the perforating gun. When the surge anchor is positioned downhole of the perforating gun, it is preferably to use the alternate configuration shown in FIG. 14. The arrangement above the upper cone is similar to that described above in relation to FIGS. 11–13.

The surge anchor comprises a downhole assembly 3 having an uphole end and a downhole end generally indicated at U and D respectively. It is generally comprised of a collar locator 6, connector sub 7, upper cone 9, a slip body 11, and complementary housing. The load sub 5 located uphole of the collar locator 6 is optional. The assembly connects at its uphole end U to a wireline and at its downhole end D to a line, perforating gun 2 or other downhole tools as shown in FIG. 10.

Figure 2:
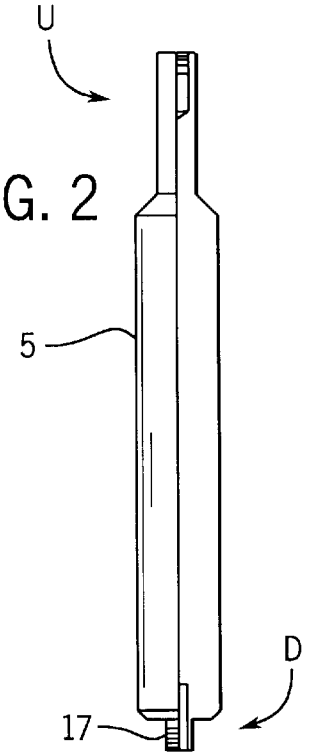
FIG. 2 is a side, perspective, partial cross-sectional view of the load sub shown in part in FIG. 1.

The uphole end U of the assembly optionally includes a load sub 5 shown in more detail in FIG. 2. The load sub 5 is generally elongated and connects at its uphole end U to a wireline. It has a threaded portion 17 at its downhole end D and connects to the collar locator 6. Any suitable connection known in the art may be used.

Figure 3A:
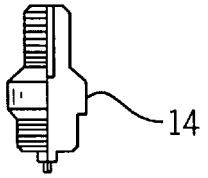
FIG. 3 is a side, perspective, partial cross-sectional view of the connector assembly used in the assembly shown in FIG. 1 including the upper ccl connection shown in FIG. 3A, connector shown in FIG. 3B, and ring shown in FIG. 3C.
Figure 3B:
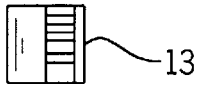
Figure 3C:
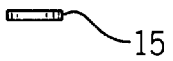

The downhole end of the collar locator 6 connects to the connector sub or coupling 7 through an upper connector assembly. One example of the upper connector assembly is shown in FIG. 3. FIG. 3A shows the upper collar locator connection 14, connector or quick change 13 and ring 15. However, a number of suitable connection assemblies are known in the art and may be used.

Figure 4:
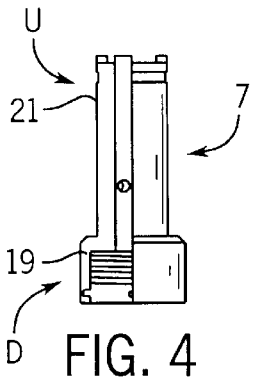
FIG. 4 is a side, perspective, partial cross-sectional view of the connector sub shown in part in FIG. 1.
Figure 5:
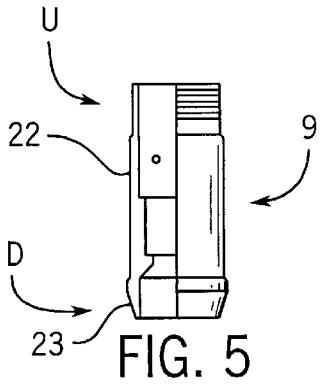
FIG. 5 is a side, perspective, partial cross-sectional view of the upper cone shown in part in FIG. 1.
Figure 6:
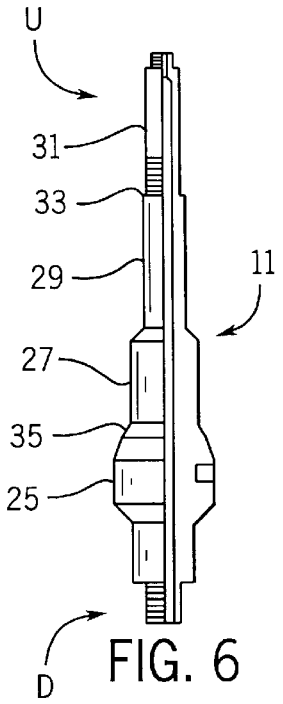
FIG. 6 is a side, perspective, partial cross-sectional view of the slip body shown in part in FIG. 1.

The connector sub or coupling 7 is shown in FIG. 4. It connects to the collar locator 6 through the connection assembly. The coupling 7 comprises a generally cylindrical tubular housing having a threaded collar 19 at its downhole end D and an elongated portion 21 extending in the uphole direction and having a diameter less than the collar 19. This coupling arrangement is generally known within the art and the components and connecting means may vary accordingly.

Turning to the components of the anchoring mechanism 1, reference is made to FIGS. 5 to 8. The upper cone 9 shown in FIG. 5 attaches to the coupling 7. The upper cone 9 is comprised of a cylindrical housing 22 having a threaded uphole end U for engaging the collar 19 of the coupling 7. Its downhole end D includes a portion which is frustoconically shaped having a radially inwardly sloped outer surface 23. The downhole end D of the upper cone 9 is adapted to telescopingly receive the upper end of the slip body 11.

The slip body 11 has an elongated cylindrical shape having a wide collar portion 25 near its downhole end D and tapers in stepped portions 27, 29, 31 to its uphole end U. The uphole end U of the slip body 11 is telescopingly received into the upper cone 9 into an extended position and may be moved in relation to the upper cone 9 between this extended position and a fully inserted position.

Figure 8A:
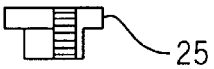
FIG. 8 is a side perspective partial cross-sectional view of the spring sub and spring of the assembly shown in FIG. 1.
Figure 8B:
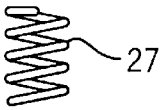
Figure 9B:
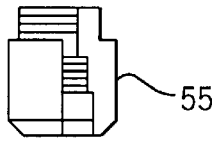

Inserted into the upper cone 9 and positioned between the upper cone 9 and the slip body 11 is a spring sub or stud 25 and a spring 27 shown in FIG. 8. The spring 27 is received over the uphole end U of the slip body 11 and rests on the annular shoulder 33 of the body 11. The spring and sub allow for the movement of the slip body 11 in the upper cone 9 between the extended and fully inserted positions. Although a spring and spring sub arrangement is shown in the drawings, any arrangement which allows for some independent movement of the slip body in relation to the upper cone may be used. For example, an alternative embodiment may include a keying arrangement between the slip body and the upper cone where the keying engagement is positioned as to allow the slip body to move upwards into the upper cone when a surge occurs without forcing the upper cone upwards.

The collar portion 25 of the slip body 11 has a circumference larger than the remaining areas of the body 11. The upper wall 35 of the collar portion 25 has a frustoconical shape comprising a radially inwardly sloped outer surface extending to the first stepped portion 27 of the slip body 11.

Figure 7A:
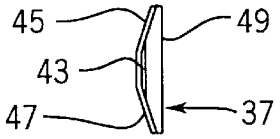
FIG. 7 is a perspective view of the slip member, slip spring and slip cage shown in part in FIG. 1.
Figure 7B:
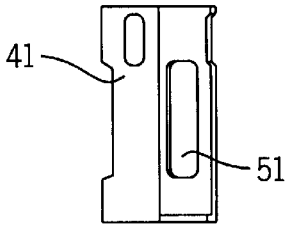

A number of slip members 37 may be positioned on the stepped portion 27 above the collar 25 of the slip body 11. One slip member 37 is shown in FIG. 7. Between the slip member 37 and the outer surface of the slip body 11 is a slip spring. The slip spring biases the slip member 37 inwardly towards the slip body 11. The slip member 37 is also frustoconical in shape having an inner wall 43 positioned next to and facing the slip body 11 with sloping uphole and downhole end sections 45, 47 corresponding to the sloping wall 35 of the collar portion 25 of the slip body 11 and the sloping downhole end portion 23 of the upper cone 9. The outer wall 49 of the slip member 37 may include a serrated edge or other means for engaging the well casing.

A slip cage 41 is received over the collar portion 25 of the slip body 11 and the slip members 37. The slip cage 41 includes a number of openings or windows 51 for allowing the slip members 37 to extend outwardly from the slip body 11 and engage the well casing as shown in FIG. 10C.

The lower end of the slip body 11 may engage a line or other assemblies or tools positioned downhole through a lower connection assembly. This assembly may be comprised of the lower wire connection 53 and quick change coupling 55 shown in FIG. 9. However, other suitable connection assemblies are known in the art and may be used.

The sloped outer surfaces of the upper and lower housings cooperate to define a recess with oppositely sloped end surfaces for receiving a slip or anchor member having complementary sloped end surfaces. The length of the recess, distance of insertion of the lower housing into the upper housing, and the length of the anchor member are selected such that the anchor member is forced radially outwardly upon movement of the lower housing towards the fully inserted position.

The anchoring mechanism will automatically engage the well casing when a surge occurs in the line and will disengage the well casing when the surge passes. It will be obvious to a skilled person that a surge may be created in a number of manners. For example, a surge may be created by the detonation of the perforating equipment, by the release of pressure in a formation, by the rebounding of pressure throughout the well or by other means.

Figure 9A:
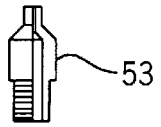
FIG. 9 is a side, perspective, partial cross-sectional view of the lower wire connector and quick change coupling of the assembly shown in FIG. 1.
Figure 10A:
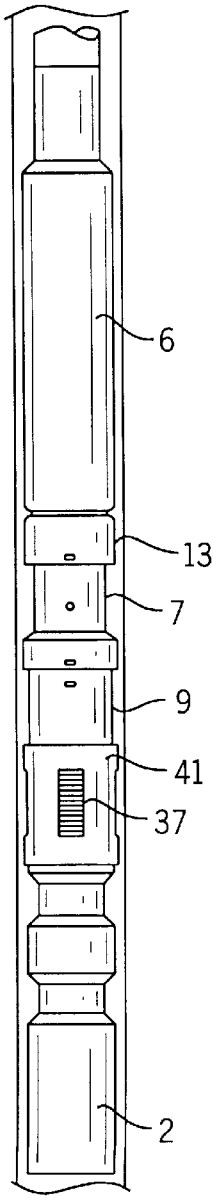
FIG. 10 is a side, perspective view of the assembly in FIG. 1 with a perforating gun attached at its downhole end, with FIG. 10A showing the assembly in a resting position, FIG. 10B showing the perforating gun activating a surge in the assembly, and FIG. 10C showing the slip members engaging the well casing in an anchored position.
Figure 10B:
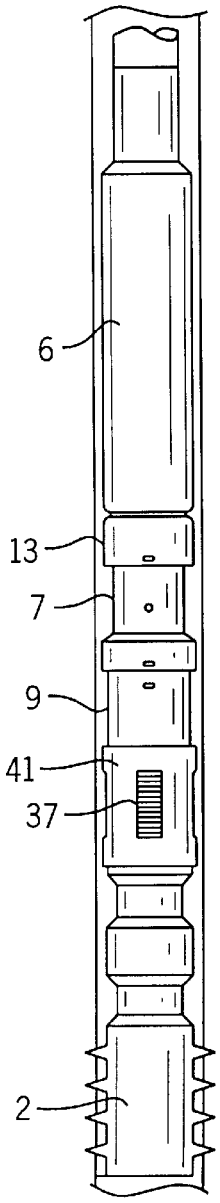
Figure 10C:
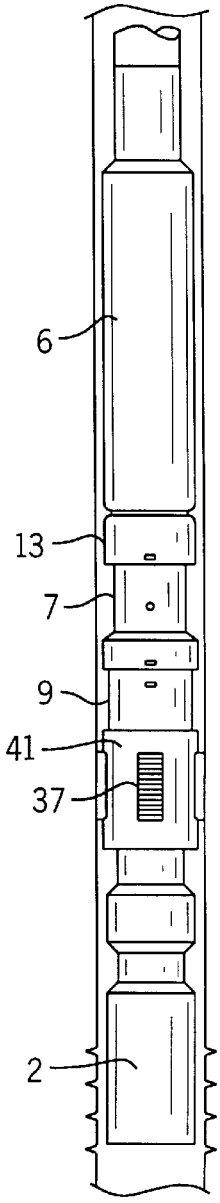

FIGS. 10A–C outline the activation of the anchoring mechanism 1. FIG. 10A shows the assembly 3 in an unanchored position in a well bore. When a surge in the line is created by downhole pressure, the slip body 11 is forced upwards towards the upper cone 9. The spring 27 is compressed allowing the slip body 11 to move upwards with minimal upward movement of the upper cone 9. The spring also provides for minimal upward movement of the remaining uphole components. As the slip body 11 is forced upward by the force of the surge, the uphole sloping surface 45 of the slip member 37 engages the complementary sloping surface 23 of the downhole end portion of the upper cone 9 and slides along this surface. At the same time, the uphole sloping wall 35 of the collar portion 25 of the slip body 11 engages the slip member 37 and slides along the complementary sloping surface 47 of the slip member 37. This action overcomes the biasing of the slip spring and the slip member 37 is forced outward from the slip body 11. The slip member 37 extends through the windows 51 in the slip cage 41. Its outer wall 49 will engage the well casing thereby anchoring the slip body 11 in position in relation to the well casing as shown in FIG. 9C. This anchoring mechanism prevents the uphole components of the downhole assembly from surging upwards and becoming damaged.

Once the surge has passed, the forces of gravity and the slip spring 27 may cause the slip body 11 to move downwards. As the slip body 11 moves downwards, the uphole sloping wall 45 of the slip member 37 will slide down and disengage the sloping downhole end portion 23 of the upper cone 9. As the slip member 37 and the slip body 11 continue to move downwards, the sloping wall 35 of the collar portion 25 of the slip body 11 will disengage the corresponding sloping wall 47 of the slip member 37. The slip member 37 is drawn back towards the slip body 11 by the slip spring 39. The slip member 37 will return to its resting position on the outer surface of the slip body 11 and within the slip cage 41 as shown in FIG. 9A. Each of the slip members 37 are similarly simultaneously activated to grip the well casing during a surge. The surge anchor may also be released using a slip joint above the slip members or a sinker bar positioned below the slip members and such methods are well known within the art.

The slip members 37 may be repeatedly activated and deactivated as work continues downhole of the assembly 3. It is not necessary to remove the assembly 3 from the well hole to reset the anchoring mechanism or to replace parts sheared during anchoring. While the anchoring mechanism 1 is described as positioned immediately uphole of the perforating gun or other downhole tool, it may be positioned at any desired point on the wireline and may be uphole or downhole of the collar locator. Further, a surge in the line may be created in any number of ways well known to those skilled in the art. The present invention is operable regardless of the method by which the surge is created, for example, whether by the release of formation pressure or by detonation of a perforating gun.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

What is claimed is:

1. An anchoring mechanism for anchoring a downhole assembly attachable thereto in a casing of a well bore, said mechanism comprising:

a first housing having a first end and an external first ramp which is radially inwardly sloped towards the first end;

a second housing having a second end telescopingly movable in the first end of the first housing between an extended position and a fully inserted position, and an external second ramp radially inwardly sloped towards the second end, wherein said first and second ramps define opposite ends of a recess;

biasing means for forcing said second housing into said extended position; and a slip member received in said recess and radially movable between a retracted position wherein the slip member does not engage the casing and an anchored position wherein the slip member engages the casing, the slip member having first and second sloped end surfaces complementary to said first and second ramps;

said first and second ramps being moved towards one another upon movement of said housing from the extended position to the fully inserted position for forcing said slip member radially outwardly into said anchored position for substantially locking the assembly in the casing against axial movement.

2. The mechanism of claim 1, wherein said slip member is reciprocatable between said retracted and anchored positions.

3. The mechanism of claim 2, wherein said biasing means is a spring.

4. The mechanism of claim 1, including a plurality of slip members.

5. The mechanism of claim 4, wherein said ramp is angled in a range of approximately 10–15° and said sloped end surface is angled in a range of approximately 10–15°.

6. An anchoring mechanism for anchoring a downhole assembly attachable thereto in a casing of a well bore, said mechanism comprising:

an elongated main body extending along an axis;

a first housing on said main body, said main body being slidably movable in relation to said first housing;

a second housing on said main body apart from said first housing and having an external first ramp sloped radially inwardly towards the first housing;

biasing means positioned on said main body and between said first and second housing;

a slip member between said first and second housing and radially movable between a retracted position wherein the slip member does not engage the casing and an anchored position wherein the slip member engages the casing, the slip member having a first sloped end surface complementary to said first ramp;

said first ramp being movable towards said first housing upon movement of said main body from a first position wherein the first ramp is apart from said first sloped end surface to a second position wherein said first ramp cooperates with said first sloped end surface for forcing said slip member radially outwardly into said anchored position for substantially locking the assembly in the casing against axial movement and said first ramp being movable away from said first housing by means of the biasing means for allowing the slip member to return to a retracted position.

7. The mechanism of claim 6, wherein said slip member is reciprocatable between said retracted and anchored positions.

8. The mechanism of claim 7, wherein said biasing means is a spring.

9. The mechanism of claim 8, wherein the first housing further comprises a second ramp, the slip member further comprises a second sloped end surface complementary to the second ramp wherein when said first ramp is movable towards said first housing and said first ramp cooperates with said first sloped end surface, said second ramp cooperates with said second sloped end surface on said slip member for forcing said slip member radially outward into engagement with the casing.

10. The mechanism of claim 9, including a plurality of slip members.

11. The mechanism of claim 10, wherein said ramp is angled in a range of approximately 10–15° and said sloped end surface is angled in a range of approximately 10–15°.

12. The method of anchoring an assembly in a casing in a bore comprising the steps of:

inserting an assembly having an anchoring mechanism into the casing of the well bore wherein the anchoring mechanism comprises a first housing having a first end and an external first ramp which is sloped radially inwardly towards the first end; a second housing having a second end telescopingly movable in the first end of the first housing between an extended position and a fully inserted position and an external second ramp radially inwardly sloped towards the second end wherein said first and second ramps define opposite ends of a recess; biasing means for forcing said second housing into said extended position; and a slip member received in said recess and radially movable between a retracted position wherein the slip member does not engage the casing and an anchoring position wherein the slip member engages the casing, the slip member having first and second sloped end surfaces complementary to said first and second ramps; and causing a force to move said housing from said extended position to said fully inserted position whereby said first and second ramps move towards one another forcing said slip member radially outwardly into said anchoring position for substantially locking the assembly in the casing against axial movement.

13. The method of claim 12, wherein the step of causing a force to move the second housing is caused by a surge created by the activation of a perforating gun.

14. The method of claim 12, wherein the step of causing a force to move the second housing is caused by a surge created by the release of pressure from a formation.

15. The method of anchoring an assembly in a casing in a bore comprising the steps of:

inserting an assembly having an anchoring mechanism into the casing of the well bore wherein the anchoring mechanism comprises an elongated main body extending along an axis; a first housing positioned around the main body, said main body being slidably movable in relation to the first housing; a second housing on the main body apart from the first housing and having an external first ramp sloped radially inwardly towards the first housing; biasing means positioned around the main body and between said first and second housing for separating said first and second housing; a slip member positioned between said first and second housing and radially movable between a retracted position wherein the slip member does not engage the casing and an anchoring position wherein the slip member engages the casing, the slip member having a first sloped end surface complementary to said first ramp; and causing a force to move the second housing towards said first housing from a first position wherein the first ramp is apart from said first sloped end surface to a second position wherein said first ramp contacts said first sloped end surface for forcing said slip member radially outwardly into said anchoring position for substantially locking the anchoring mechanism in the casing against axial movement.

16. The method of claim 15, wherein the step of causing a force to move the second housing is caused by a surge created by the activation of a perforating gun.

17. The method of claim 15, wherein the step of causing a force to move the second housing is caused by a surge created by the release of pressure from a formation.

18. The method of anchoring an assembly to a casing in a bore comprising the steps of:

driving a main body having a first ramp thereon in a first direction in a bore for cooperating with a complementary sloped surface on a slip member wherein the slip member is biased towards the main body, thereby forcing the slip member into engagement with the casing.

* * * * *